United States Patent [19]

Fraser, Jr. et al.

[11] Patent Number: 5,007,808

[45] Date of Patent: Apr. 16, 1991

[54] SLOTTED ROTOR LUBRICATION SYSTEM

[75] Inventors: Howard H. Fraser, Jr., Lafayette; Mark P. Weldon, Liverpool, both of N.Y.

[73] Assignee: Carrier Corporation, Syracuse, N.Y.

[21] Appl. No.: 451,152

[22] Filed: Dec. 15, 1989

[51] Int. Cl.[5] ..... F04B 39/02

[52] U.S. Cl. ..... 417/368; 417/423.7; 184/6.18

[58] Field of Search ..... 417/368, 423.7; 184/6.18

[56] References Cited

U.S. PATENT DOCUMENTS

| | | | |
|---|---|---|---|
| 2,735,026 | 2/1956 | Moerk | 417/368 |
| 2,769,105 | 10/1956 | Altschwager | 417/368 |
| 3,790,309 | 2/1974 | Volz | 417/368 |
| 4,138,862 | 2/1979 | Müller | 417/368 |
| 4,488,855 | 12/1984 | Butterworth et al. | 417/368 |
| 4,623,306 | 11/1986 | Nakamura et al. | 184/6.18 |

FOREIGN PATENT DOCUMENTS

| | | | |
|---|---|---|---|
| 2033723 | 12/1970 | France | 417/368 |

*Primary Examiner*—Michael Koczo
*Assistant Examiner*—David L. Cavanaugh
*Attorney, Agent, or Firm*—Wall and Roehrig

[57] ABSTRACT

A hermetic vertical shaft compressor for refrigeration or air conditioning uses a single-stage centrifugal pump formed in the rotor assembly to lubricate bearing surfaces. Oil is picked up from a sump at the base of the rotor, and is thrown into an annulus in the rotor. From here the oil proceeds up axial slots formed in the rotor laminations to an upper annulus, where it feeds lubrication channels in the upper bearing. The shaft has a reduced diameter thereby reducing material costs and reducing hystersis and eddy current losses, while achieving increased pumping capacity and pressure.

5 Claims, 1 Drawing Sheet

SLOTTED ROTOR LUBRICATION SYSTEM

BACKGROUND OF THE INVENTION

This invention relates to rotating machines, e.g. rotary compressors and scroll compressors for refrigeration or air conditioning, especially compressors of the type which are hermetically sealed and have a vertical rotating shaft that serves as both a rotor shaft and as a centrifugal lubrication pump. The invention is more particularly directed to a rotor assembly construction which provides a greater lubricating capacity and also increases the efficiency of the compressor.

In rotary compressors and scroll compressors, an electric motor drive is built into the housing or shell, and has a stator or electric armature affixed in the shell and a rotor assembly that fits into a cylindrical passage in the stator. The rotor assembly has a shaft that is rotationally supported and journalled in a bearing housing, in some cases at one side of the rotor and in some cases both above and below the rotor. As these compressors are situated vertically, i.e., with the rotor axis vertical, lubricant reposes in a sump or reservoir at the lower end of the shaft. Typically, the rotary motion of the rotor shaft is availed upon as a single-stage centrifugal pump to drive the lubricating oil upward by centrifugation. That is, an oil tube at the lower end of the shafts dips into the reservoir and picks up the oil, which moves upward into a hollow center of the shaft. The conventional shaft has one or more axial bores disposed off axis to carry the oil to the top of the shaft, where the oil proceeds through one or more lubricating channels to oil the bearing or bearings and other moving parts. A central axial bore in the shaft serves as a vent.

The requirement for the several bores, which must be positioned in the shaft, raises the production cost of the rotor assembly. Also, the shaft has to be of a rather large diameter to accommodate the lubrication bores or channels. This necessitates a larger center bore in the laminations that make up the rotor, with a consequent reduction in magnetic material towards the axis. There are significant eddy current losses involved, which it would be desirable to reduce.

OBJECTS AND SUMMARY OF THE INVENTION

It is an object of this invention to provide a hermetic, vertical shaft compressor with increased oil pumping capacity and increased oil pressure.

It is another object of this invention to provide a compressor rotor assembly which has lower production costs by virtue of a reduction in shaft material and a reduced requirement for machining.

It is still another object of this invention to provide a compressor of increased motor efficiency because of reduced hysteresis and reduced eddy current losses in the rotor.

According to an aspect of this invention, the rotor assembly for the vertical-rotor hermetic compressor has a shaft with a central portion of a predetermined diameter and an upper portion of a greater diameter. The shaft upper portion is journalled in a bearing housing. A lower end of the shaft extends downward and is in communication with an oil reservoir or sump. A rotor is formed of a stack of laminations which have a central bore to receive the central portion of the shaft and are affixed onto it. There are conductive bars that extend through aligned openings in the laminations between upper and lower conductive rings and serve as the induction armature. The laminations are formed of ferromagnetic material. Cutouts are provided in each lamination adjacent to the central bore, and in the stack these cutouts are aligned to create one or more axial slots or oil channels. There is a lower annular groove formed in the rotor at its lower end, and this connects with the axial slots or upper channels. Another annular groove at the upper end connects with the upper ends of the slots. There are one or more oil distribution channels within the upper portion of the shaft that connect with the upper annular groove and which open onto the surfaces to be lubricated. In this arrangement, oil enters from the sump and is forced upwards in the central bore of the shaft, and then is thrown radially out a port against the walls of lower annular groove. The oil is driven centrifugally up the rotor slots to the upper annular groove. From here, the oil feeds the bearing surfaces.

The central port of the shaft is smaller than the conventional shaft diameter because the oil slots are outside it in the rotor laminations. For this reason the laminations extend radially more inward than in the conventional construction. More magnetic flux is contained in the rotor laminations, and less flux reaches the shaft, so eddy current losses are reduced.

The above and many other objects, features, and advantages of this invention will be understood from the ensuing description of a preferred embodiment, to be read in conjunction with the accompanying Drawing.

DETAILED DESCRIPTION OF THE PREFERRED EMBODIMENTS

Figure 1:
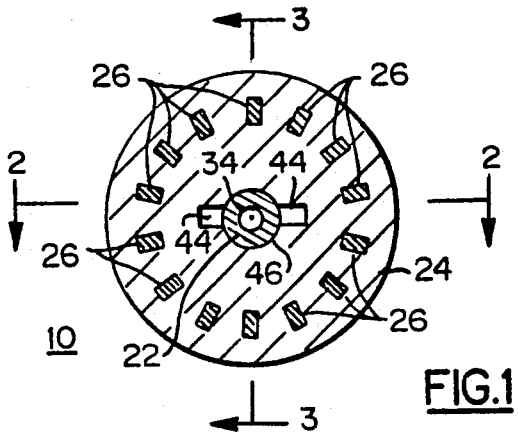
FIG. 1 is a sectional view of a rotor assembly according to one embodiment of the present invention, as viewed at 1—1 in FIG. 2.
Figure 2:
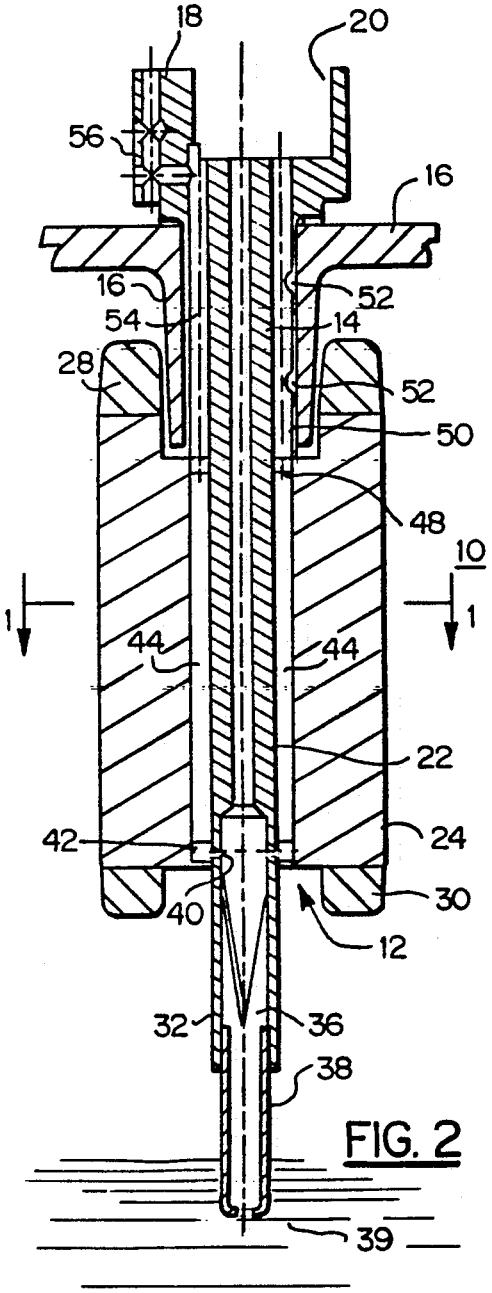
FIG. 2 is a cross sectional view taken at 2—2 of FIG. 1.
Figure 3:
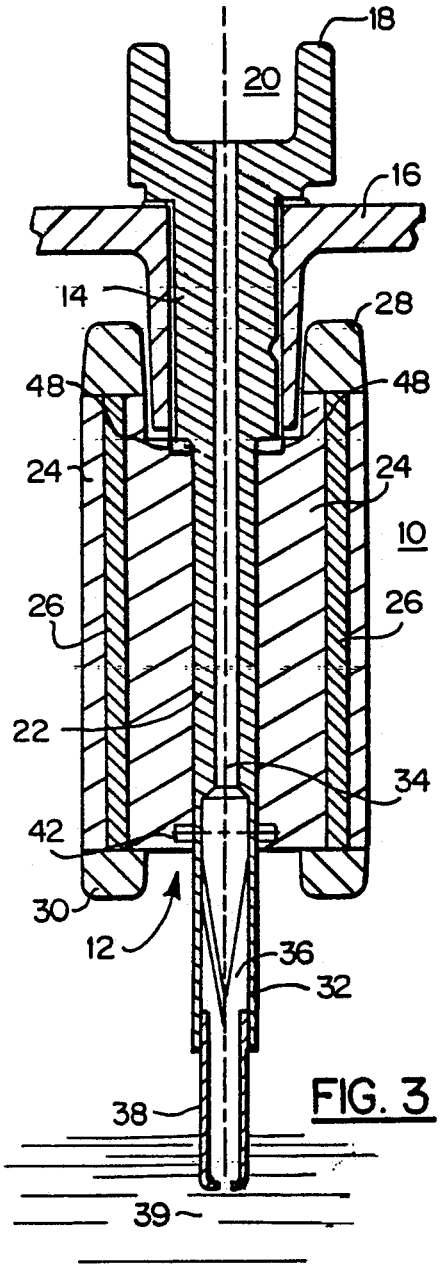
FIG. 3 is a cross sectional view taken at 3—3 of FIG. 1.

With reference to FIGS. 1, 2, and 3 of the Drawing, a rotor assembly 10 has a vertical shaft 12 with an upper bearing portion 14 that is rotationally supported in a bearing housing 16. The latter is itself affixed in the outer shell of a rotary compressor or scroll compressor, not shown. At the upper end of the shaft upper portion 14 is a crank 18 that has an eccentric female fitting or socket 20 to drive a rotor or an orbiting scroll of the compressor. A central portion 22 of the shaft 12 has attached to it a rotor 24 that is formed of a plurality of stacked ferromagnetic laminations and a row of axial conductor bars 26 that pass through aligned openings in the laminations and connects to an upper rotor ring 28 at one end of the rotor 24 and to a lower rotor ring 30 at the lower end. A lower part 32 of the shaft extends downward below the rotor 24. Also not shown is a stator surrounding the rotor 24 and supported within the compressor shell. However, the design of the stator and of the other compressor parts is well known to those skilled in the art.

The upper bearing portion 14 of the shaft 12 is of a suitable diameter to accommodate the bearing housing 16, while the central portion 22 is of a smaller predetermined diameter. A central, axial bore 34 extends to the top of the shaft 12 and serves as a vent. A widened portion 36 of the bore extends from the bottom of the shaft lower part 32 just into the central portion 22, and serves as an oil bore. An oil pickup tube 38 extends downward from here into an oil sump 39 at the base of the compressor. The bore 34 is narrow above the top of the widened portion 36.

When the rotor assembly is turning, the oil is picked up by the tube 38 and is brought by centrifugal action up the widened bore 36 to the base of the shaft central portion 22. There the oil is thrown outward through one or more ports 40 or openings through the shaft wall at the upper end of the widened portion 36 of the bore 34, and into an annulus 42 or plenum that extends around the shaft 12 within the rotor 24 at its lower end. A pair of vertical slots or channels 44 extend through the rotor 24 and alongside the shaft 12 to the upper end of the rotor 24. As shown in FIG. 1, each lamination of the rotor 24 has a central circular opening or bore 46 that is firmly fitted onto the central portion 22 of the shaft, and the channels 44 are easily formed as notches or cutouts oppositely disposed on the edges of the opening 46. The notches align in the stack of laminations to form the generally axial channels or slot 44. These channels connect at their upper ends to an upper annulus or plenum 48 at the tip of the rotor 24 and adjacent the bearing plenum 48 at the tip of the rotor 24 and adjacent the bearing portion 14 of the shaft. The oil moves from here through a lubrication channel 50 in the upper bearing portion 14 and onto the bearing surface through lubrication ports 52. An additional lubrication channel 54 extends from the upper annulus 48 axially through the upper bearing portion 14 to the crank 18 and brings oil to one or more additional lubrication channels 56.

Because the axial slots or channels 44 are formed in the rotor laminations rather than in the shaft 12, at least the central portion 22 of the shaft, where the rotor 24 is mounted, can be smaller than is otherwise possible. This has a number of benefits. Less material is required for the shafts, and machining of the usual oil channels in the shaft is not required, thereby reducing the cost of producing the shaft 12. Also, because of the reduced shaft diameter, the rotor laminations extend radially closer to the axis than otherwise. Therefore, more of the magnetic rotor flux remains in the laminations, and less reaches the metal of the shaft, thereby reducing hysteresis and eddy current losses.

Also, placing the slots 44 radially outside the confines of the shaft increases the centrifugal forces that pump the oil upward, thus increasing both oil pumping capacity and oil pressure.

Also, the slots 44 need not be precisely straight, but may be somewhat helical without departure from the main principles of this invention.

While the invention has been explained with reference to an exemplary preferred embodiment, it should be recognized that the invention is not limited to that precise embodiment. Rather, many modifications and variations will be apparent to those skilled in the art without departure from the scope or spirit of the invention, as defined in the appended claims.

What is claimed is:

1. A vertical rotor structure for a hermetic compressor, the rotor structure comprising:

a shaft having a central portion of a predetermined diameter and an upper portion of a greater diameter which fits into a bearing of the compressor, said shaft having an axial central bore, and means on a lower end of said shaft for carrying a liquid lubricant into the bore of said shaft;

a rotor disposed on the central portion of said shaft and formed of a stack of laminations, with an upper one of said laminations abutting a lower end of said upper portion of the shaft, said stack having a central bore to receive said shaft central portion and at least one slot therein continuous with said central bore and extending generally axially;

a lower distribution channel communicating radially from the central bore to a lower end of said at least one slot for permitting the lubricant to flow into said at least one slot where it is driven by rotational forces to an upper end of the at least one slot; and at least one upper distribution channel in said shaft upper portion which communicates through a lower end of the upper portion directly with the upper end of said at least one slot and which conducts the lubricant from the upper end of said at least one slot to one or more bearing surfaces of said upper portion.

2. A vertical rotor structure according to claim 1 wherein said at least one slot includes a pair of slots situated diametrically opposite one another.

3. A vertical rotor structure according to claim 1 wherein said lower distribution channel includes an annular void in said stack in communication with the lower end of said at least one slot, and a port through a lower end of said shaft central portion into said annular void.

4. A vertical rotor structure according to claim 3 further comprising an upper annular void in said rotor at the upper end of said at least one slot and connecting to said at least one upper distribution channel.

5. A vertical rotor structure according to claim 3 wherein said central bore has an enlarged diameter substantially from the location of said port to the lower end thereof, and a reduced diameter from said location to an upper end of the shaft.

* * * * *